US005524774A

United States Patent [19]

Cullen

[11] Patent Number: 5,524,774

[45] Date of Patent: Jun. 11, 1996

[54] HANGING RACK WITH CANTILEVERED SUPPORT HOOKS

[75] Inventor: Lawrence E. Cullen, Chicago, Ill.

[73] Assignee: Mighty Hook, Inc., Chicago, Ill.

[21] Appl. No.: 281,774

[22] Filed: Jul. 28, 1994

[51] Int. Cl.[6] ..... A47F 5/00

[52] U.S. Cl. ..... 211/113; 211/119; 204/297 W; 118/500

[58] Field of Search ..... 211/113, 117, 211/119, 103; 118/500; 204/297 W; 248/231.9, 218.4, 219.1, 219.3, 219.4, 220.2, 220.3, 302, 303

[56] References Cited

U.S. PATENT DOCUMENTS

| | | | |
|---|---|---|---|
| 1,226,856 | 5/1917 | Bradley . | |
| 1,452,321 | 4/1923 | Allen . | |
| 1,533,805 | 4/1925 | Oliver . | |
| 2,730,988 | 1/1956 | Starkey | 118/51 |
| 2,858,265 | 10/1958 | Schneider | 204/297 |
| 2,858,266 | 10/1958 | Schneider | 204/297 |
| 2,953,512 | 9/1960 | Villette | 204/297 |
| 3,001,926 | 9/1961 | Belke | 204/297 W |
| 3,029,952 | 4/1962 | Bagdon et al. | 211/117 |
| 3,272,733 | 9/1966 | Belke | 204/297 |
| 3,294,668 | 12/1966 | Belke | 204/297 |
| 3,376,156 | 4/1968 | Whitaker et al. | 117/93.2 |
| 4,015,809 | 4/1977 | Buril | 248/218.4 X |
| 4,025,018 | 5/1977 | Thalenfeld | 248/303 |
| 4,037,727 | 7/1977 | Kunkle | 211/117 |
| 4,093,168 | 6/1978 | Buril | 248/218.4 X |
| 4,097,359 | 6/1978 | Davitz | 204/297 |
| 4,217,853 | 8/1980 | Davitz | 118/500 |
| 4,243,146 | 1/1981 | Davitz | 211/118 |
| 4,289,090 | 9/1981 | Bagby et al. | 118/630 |
| 4,319,531 | 3/1982 | Caldwell | 248/220.3 X |
| 4,424,908 | 1/1984 | Davitz | 211/118 |
| 4,450,954 | 5/1984 | O'Connell | 198/793 |
| 4,752,371 | 6/1988 | Kreisel et al. | 204/297 |
| 4,831,962 | 5/1989 | Gros | 118/423 |
| 4,936,565 | 6/1990 | Fredrickson | 248/220.3 X |
| 5,088,609 | 2/1992 | Frye | 204/297 W X |
| 5,147,050 | 9/1992 | Cullen | 211/118 |
| 5,443,167 | 8/1995 | Menaged et al. | 211/103 X |

FOREIGN PATENT DOCUMENTS

| | | |
|---|---|---|
| 1079916 | 4/1960 | Germany . |
| 893056 | 4/1962 | United Kingdom . |

*Primary Examiner*—Robert W. Gibson, Jr.
*Attorney, Agent, or Firm*—Fitch, Even, Tabin & Flannery

[57] ABSTRACT

A rack for transporting workpieces through electrostatic coating operations. The rack includes a pair of vertically extending, rectangularly cylindrical hollow tubes having apertures formed in their front sides. A support hook has a workpiece engaging portion, offset portions extending from either end of the workpiece engaging portion, and contact portions extending from the ends of the offset portions, with each adjacent portion of the support hook extending perpendicularly to its adjacent portion. The support hook is manually engageable with the tubes by insertion of the contact portions of the hook into the apertures of the respective tubes. The hook is cantilevered to the tubes, with the workpiece engaging portion spaced from the tubes. The tubes shield their interior surfaces and the contact portions of the support hook disposed in their interiors from the sprayed particulate. Objects hung from the workpiece engaging portion of the hook biases the shielded contact portions of the hook against the shielded interior surfaces of the respective tubes to assure good electrical contact between the support hooks and the tubes.

12 Claims, 3 Drawing Sheets

HANGING RACK WITH CANTILEVERED SUPPORT HOOKS

FIELD OF THE INVENTION

The present invention pertains to support racks used for supporting workpieces in electrically conductive contact during transport through an electrostatic finishing station, and more particularly, to such support racks having removable, interchangeable support hooks.

BACKGROUND OF THE INVENTION

Workpieces are supported on support racks and carried along by a conveyor through a finishing station which may include the steps of cleaning, rinsing, drying, coating and baking. Usually finishing includes travel through an electrostatic spray booth wherein electrically grounded workpieces are sprayed and coated with electrically charged paint particulate. Workers then removed the finished, coated workpieces from the racks and reuse the racks for subsequent operations. Since the racks are constantly recycled through the finishing system, they become encrusted with multiple layers of the coating material after several runs.

It is important in electrostatic coating operations that the support rack be electrically conductive, whereby workpieces can be maintained in a grounded electrical state. The workpieces are electrically connected to ground potential through the conductive support rack so that the electrically charged coating particulate is attracted by an electric field to the workpieces. Thus, it is desirable to provide a support rack wherein the electrical contact between each support hook and the frame of the support rack is maintained as a good, low resistance electrical contact so that the suspended workpieces will remain well grounded. An example of one type of support rack is disclosed in U.S. Pat. No. 5,147,050 entitled "Custom Hanging Rack With Interchangeable Support Hooks and Method Therefore".

Each painting or coating operation applies a coating layer to the exposed, workpiece-engaging portion of the support hooks which coating entirely covers the hooks except for the small area of contact with the workpiece. Unless a very similar workpiece is to be run in a subsequent operation, whereby the workpiece would be in electrical contact with the hook at an identical part, it is necessary to provide a clean support hook to assure the requisite electrical contact between the workpiece and the support hook. Accordingly, it is desirable that the support hooks be detachably engaged to the frame of the rack so that the hooks can be periodically removed and replaced with new or cleaned hooks. Simple and rapid interchangeability of the support hooks is also desirable so that different sizes and shapes of support hooks can be interchanged as desired to allow for customization of the rack to suit the requirements of a wide variety of runs. It is desirable to provide this interchangeability while still maintaining good electrical contact between each support hook and its respective support rack during electrostatic painting operations or the like.

It is desirable that the support rack lend itself to simple and inexpensive manufacture while still providing for flexibility and also good electrical contact of the workpieces supported.

SUMMARY OF THE INVENTION

In accordance with the present invention, there is provided an inexpensive support rack for supporting workpieces during transport through a finishing station while maintaining positive electrical contact of the workpieces. The rack comprises a support frame including a tube having an interior surface defining an elongated, substantially enclosed hollow interior. A hook-receiving aperture is formed in the tube, extending into the hollow interior of the tube. A support hook is provided having a tube-engaging portion receivable into the hook-receiving aperture of the tube and engageable with the tube for cantilevered engagement of the support hook with the tube. The support hook also has a workpiece-engaging portion for supporting the workpieces in spaced relation from the tube. During the cantilevered engagement of the support hook with the tube, the tube-engaging portion received in the hook-receiving aperture contacts the interior surface of the tube. The weight of the workpieces engaged with the workpiece-engaging portion of the support hook biases and maintains the tube-engaging portion of the support hook in positive electrical contact with the interior surface of the tube.

BRIEF DESCRIPTION OF THE DRAWINGS

In the drawings, wherein like elements are referenced alike.

DETAILED DESCRIPTION OF THE PREFERRED EMBODIMENTS

Figure 1:
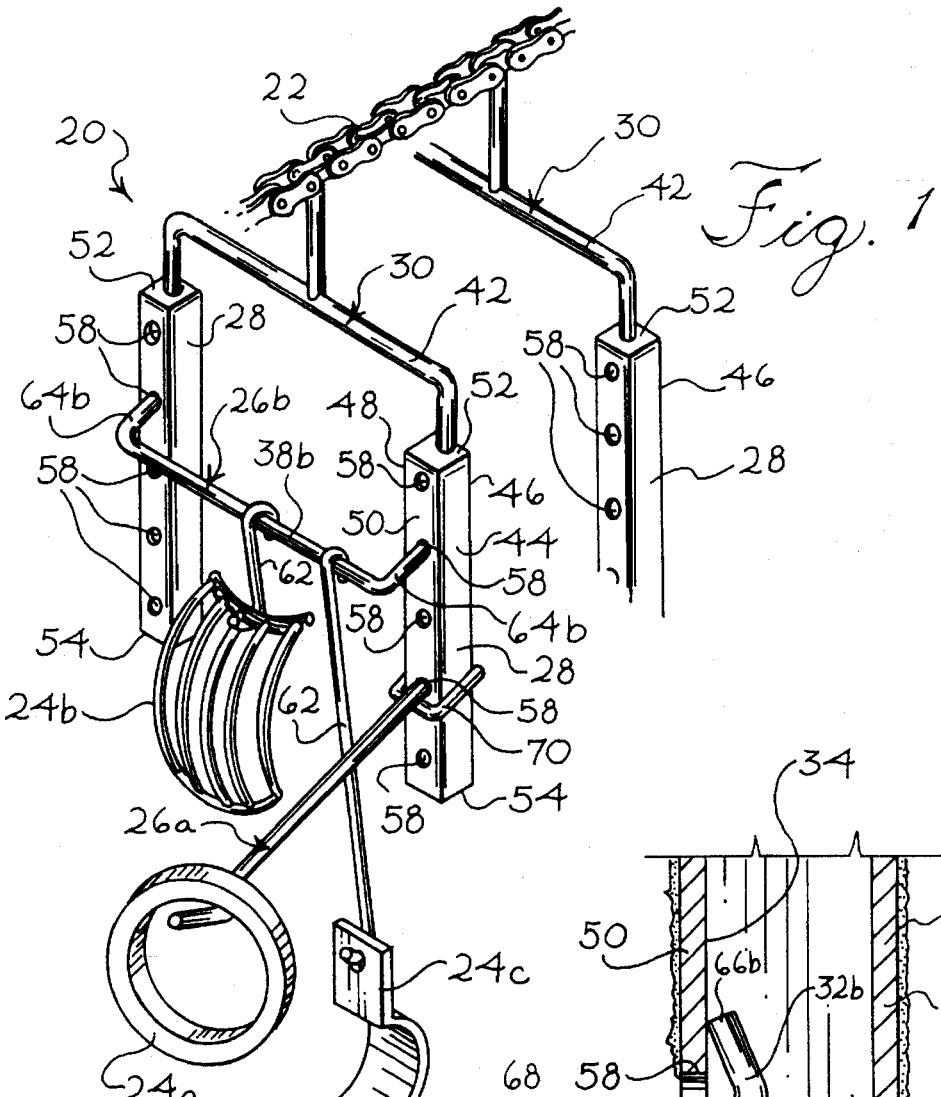
FIG. 1 is a perspective view of a hanging rack with cantilevered support hooks embodying various features of the present invention.

A hanging rack embodying various features of the present invention is illustrated in FIG. 1 and referred to generally by reference numeral 20. The hanging rack 20 is shown depending from a chain conveyor drive 22 which transports a plurality of hanging racks 20, with respective workpieces 24 thereon, through electrostatic coating operations and the like. Workpieces 24 are hung from support hooks, which are referred to generally by reference numeral 26, and which are detachably engageable with one or more tubes 28 of a support frame 30. The tubes 28 have hook-receiving apertures 30 which receive tube-engaging portions 32 of the support hooks 26 for cantilevered engagement of the support hooks 26 with respective tubes 28.

Figure 2:
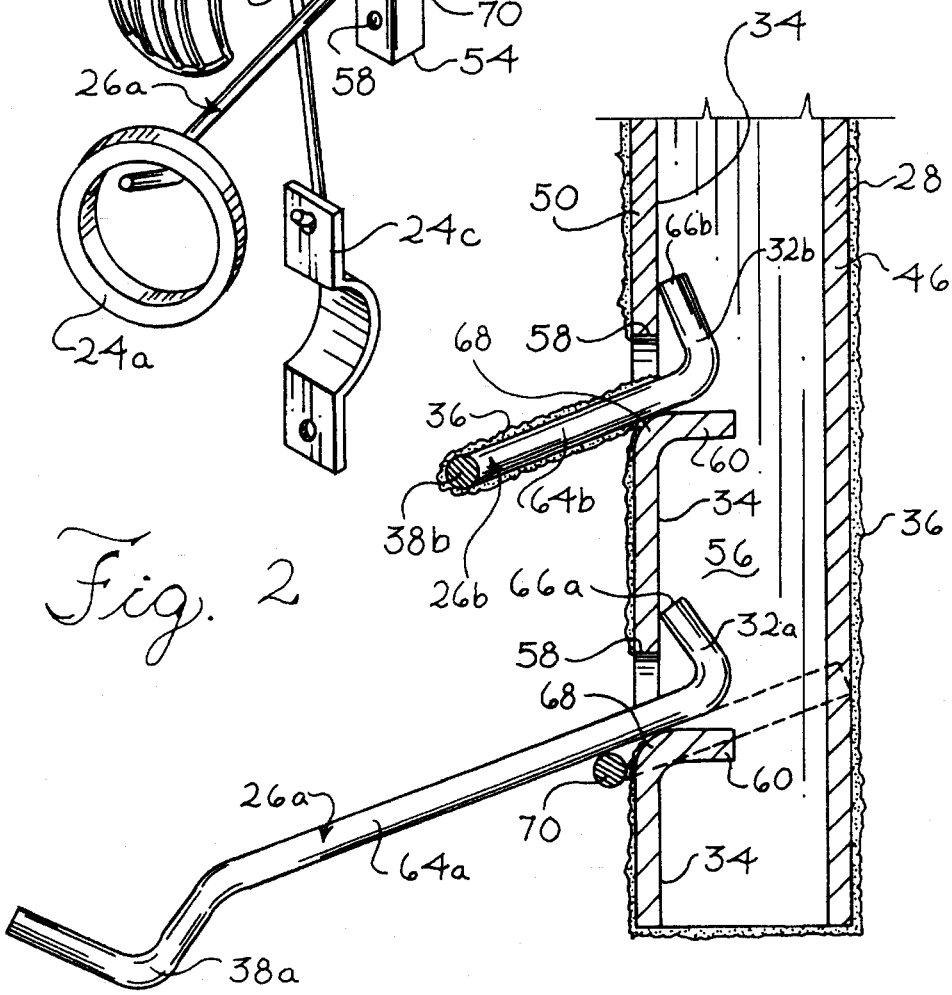
FIG. 2 is a sectional view of the hanging rack of FIG. 1, showing the contact of the hooks with the interior surface of the tube.

The support hooks 26 have a contact portion 32 which resides interiorly of the tube 28 upon engagement of the support hooks 26 with the tubes 28. As best seen in FIG. 2, the contact portion 32 of the support hook 26 is biased into abutment with the interior surface 34 of the tube 28 under the influence of the weight of the workpieces 24 hung from workpiece-engaging portions 38 of the support hooks 26. In addition to serving as a supporting and support hook engaging component, the tube 28 serves as a shield to the particulate 36 and prevents the particulate from contaminating the interior of the tube 28. Since neither the internal surface 34 of the tube 28 nor the contact portion 32 of the support hooks 26 disposed within the tube 28 are exposed to particulate associated with electrostatic painting or the like, a good electrically conductive contact is maintained between the support hooks 26 and the tube 28 despite the build-up of particulate 36 on the exterior surface 40 of the tube 28. Thereby, good electrostatic attraction of the charged particulate to the workpieces 24 supported on the support hooks 26 is maintained throughout electrostatic painting operations.

More specifically, as shown in FIG. 1 a plurality of support frames 30 depend from a chain conveyor drive 22 in spaced relation to one another. The support frames 30 each comprise a generally horizontal crossbar 42 with tubes 28 depending downwardly from either end of the crossbar 42 and extending generally vertically. The illustrated tubes 28 are rectangularly cylindrical, having four sides 44, 46, 48 and 50, and having a closed upper end 52, with the lower end 54 of the tubes preferably left open, to allow drainage of water from the tubes. The four sides 44, 46, 48 and 50 and the closed upper end 52 of the tube 28 defining a hollow interior 56. A plurality of vertically spaced apertures 58 are formed in the front side 50 of the tubes 28 extending into the hollow interior 56 of the tubes 28. As discussed in detail below, the apertures 58 receive the contact portions 32 of the support hooks 26 therethrough for simple manual cantilevered engagement of the support hooks 26 with the tubes 28. Also, for reasons which will become clear as the description of the invention proceeds, the apertures 58 are preferably formed by a punching operation to leave short integral projections 60 extending inwardly from the front surface 50 immediately beneath each of the apertures 58.

Figure 4:
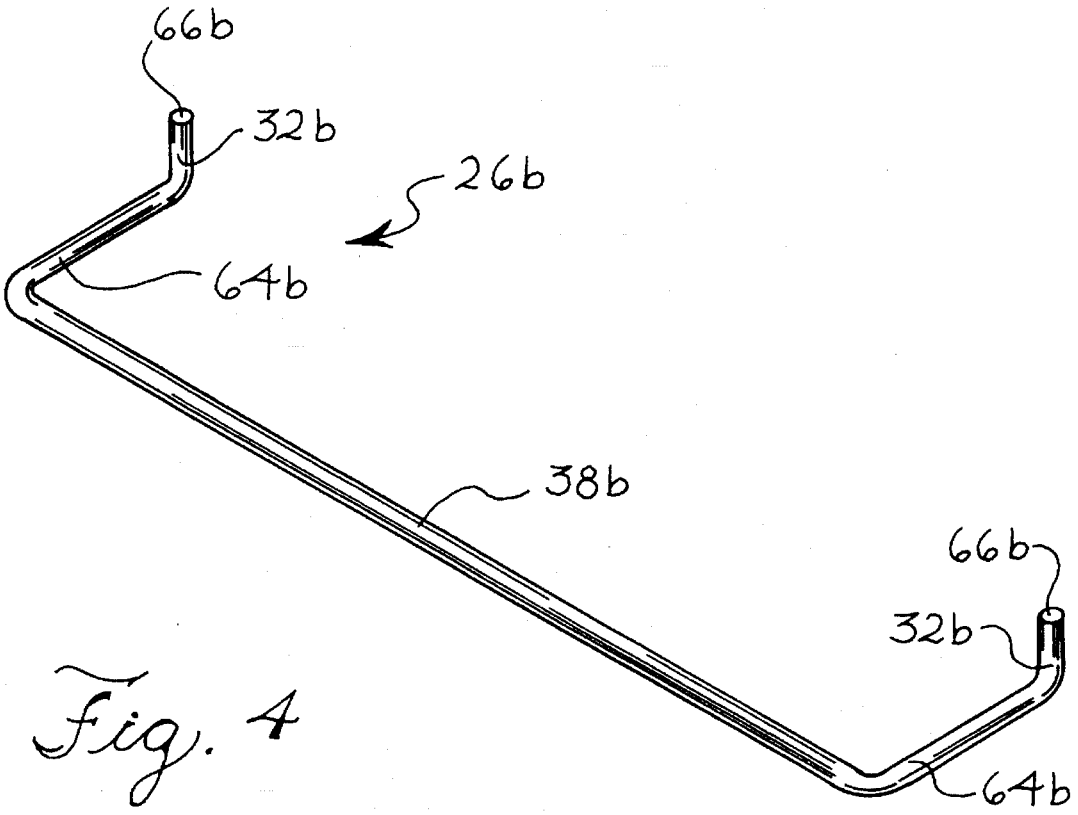
FIG. 4 is a perspective view of another support hook embodying various features of the present invention.

The preferred support hook **26*b* illustrated in FIGS. 1 and 4, has a workpiece engaging portion 38*b* from which one or more workpieces 24 may be hung, offset portions 64*b* for spacing the workpiece-engaging portion 38*b* from the tubes 28, and contact portions 32*b*. Each of the workpiece engaging portion 38*b*, offset portions 64*b*, and contact portions 32*b* of the support hook 26*b* extend mutually perpendicularly with respect to one another, as best seen in FIG. 4**.

The support hook **26*b* is easily manually engageable with the tube 28. To engage the support hook 26*b* with the tube 28, the support hook 26*b* is manually lifted and oriented such that its contact portions 32*b* extend substantially horizontally and its workpiece-engaging portion 32b extends horizontally and above the contact portions 32. The pair of contact portions 32*b* are inserted through respective apertures 58 of the tubes 28 and the support hook 26*b* is then released whereupon the workpiece-engaging portion 32*b* of the support hook 26*b* falls downwardly under the influence of gravity to the position shown in FIGS. 1 and 2. Downward movement of the support hook 26*a* when released is limited by abutment of the contact portions 32*a* of the support hook 26*a* with the interior surfaces 34 of the front side 50 of the tubes. More specifically, upon release of the support hook 26*b* following insertion of its contact portions 32*b* into respective apertures 58, the offset portions 64*b* each bear against a corner 68 at the lower end of the aperture 58. The corners 68 serve as fulcrums against which, and about which, the support hook 26*b* pivots under the influence of gravity. The support hook 26*b* pivots about the corner 68 until is limited by contact of the ends 66*b* of the contact portion 32*b* of the support hook 26*b* abut the interior surface 34 of the tube 28. The support hook 26*b* remains engaged with the tube 28 and supported by the tube 28 in cantilevered engagement therewith as shown in FIGS. 1 and 2. That is, the peripheries of the ends 66*b* of the support hook 26*b* remain bearing against the inner surfaces 34 of respective tubes 28, and the offset portions 64*b* of the support hook 28 remain bearing against respective corners 68, to maintain the support hook 26*b* in cantilevered engagement with the tubes 28**.

As seen in FIGS. 1 and 2, with the support hook **26*b* in cantilevered engagement with the tubes 28, the workpiece-engaging portion 28*b* of the support hook 26*b* is laterally offset from the corners 68. Hence, hanging of workpieces 24 from the workpiece-engaging portion 38*b* of the support hook 26*b* exerts a downward force on the workpiece-engaging portion 38*b* which forces or biases the end 66*b* of the contact portion 32*b* of the support hook 26*b* into firm abutment with the interior surface 34 of the tube 28. The heavier the workpieces, the greater the force biasing the contact portions 32*b* into abutment with the interior surface 34 of the tube 28. More specifically, the offset portion 64*b* is preferably made sufficiently long that the distance between the workpiece-engaging portion 38*b* and the fulcrum corner 68 is greater than the distance between the end 66*b* and the fulcrum corner 68. Hence, there is a greater moment arm between the workpiece-engaging portion 38*b* of the support hook 26*b* and the fulcrum corner 68 of the tube 28 than there is between the end 66*b* and the fulcrum corner 68, so that the downward force exerted by the workpieces 24 on the workpiece-engaging portion 38*b* of the support hook 26*a* results in an even greater force urging the end 66*b* against the interior surface 34**.

As discussed above, and as illustrated in FIG. 2, electrostatic painting results in the build-up of particulate 36 over the exterior of the tube 28, the workpiece-engaging portion **38*b* of the support hook 26*b*, and the surfaces of the offset portion 64*b* of the support hook 26*b* protruding outwardly of the tube 28. The tube 28 acts as a shield or barrier, so that the internal surface 34 of the tube 28 and the surfaces of the offset portion 64*b* disposed within the interior 56 of the tube 28** are not exposed to the particulate.

Though the tubes 28 are not fully enclosed, i.e. the tubes each have a plurality of apertures 58 extending into the tube interior 56, electrically charged particulate does not pass through the apertures of the grounded tube 28 since the electrostatic phenomenon thereat approximates a Faraday Cage, and the faraday cage effect resists passage of particulate through the apertures. Also, the edges of the tube 28 surrounding the apertures 58 produce a high density electrostatic charge thereat which further deflects the charged particulate and prevents it from passing through the apertures 58 into the tube interior 56.

Since both the interior surface 34 of the tube 28 and the contact portions **32*b* of the support hook 26*b* are substantially free of particulate, and the contact portions 32*b* of the support hook 28 are maintained biased against the interior surface 34 of the tube 28, good electrical contact is maintained between the tube 28 and the support hook 26*b*, despite the build-up of particulate 36 over the portions of the tubes 28 and support hooks 26 disposed externally of the tube interior 56. The maintenance of good electrical contact between the tube 28 and the support hook 26*b* from which workpieces 24** are hung is essential in carrying out successful electrostatic coating operations.

Though the accumulation of particulate on the exterior of the tube 28 does not affect the conductivity between the tube 28 and the support hooks 24, accumulation of particulate on the workpiece-engaging portion 38*b* of the support hooks 24 does present potential conductivity problems. That is, during transport through an electrostatic coating operation, the entire surface of the exposed workpiece engaging portion 38*b* of the support hook 26*b* will accumulate particulate thereon except on the areas at which the workpieces 24 are hung. The workpieces 24 may be hung either directly from the workpiece engaging portions 38 of the support hooks 26 (see workpiece 24*a* hung directly on support hook 26*a*, which is discussed further below) or may be hung indirectly from the workpiece engaging portions 38 through hangers 62 (see workpieces 24*b* and 24*c*).

The workpiece-engaging portion 38*b* of the support hook 26*b* is shielded by the workpieces 24, or its supporting hanger 62 if employed, at the points of connection of the workpieces 24 and/or hangers 62 thereto, thus preventing particulate from accumulating directly at the point of connection. Thus, good electrically conductive contact is maintained between the support hook 26*b* and the workpiece supported thereby throughout transport despite the accumulation of particulate on the support hook 26*b* everywhere except the point of connection of the workpieces to the support hook 26*b*.

However, when a different workpiece is run which contacts the workpiece-engaging portion 38*b* of the support hook 26*b* at a different location than the previously run workpiece, the point of contact between the workpiece 24 and the support hook 26*b* may not include the previously shielded, and thus uncoated, portion of the support hook 26*b*. Thus, unless the support hook is cleaned to remove the coated particulate therefrom, there will not be good electrical contact between the workpieces 24 and the support hook 26*b*.

The support hooks 26*b* of the present invention are easily manually attachable and detachable from the tubes 28 of the support frame to allow for removal of coated support hooks 26*b* and insertion of clean support hooks 26 following a coating run. Thus, by maintaining a supply of extra support hooks 26, clean support hooks can be employed at all times, while particulate-coated support hooks 26 are being cleaned for later use. Continual employment of clean support hooks 26 assures good electrical contact between the support hooks 26 and their associated workpieces 24 depending therefrom. The construction of the hanging rack 20 of the present invention allows easy manual removal of coated support hooks 26, and easy manual replacement of clean support hooks 26 into cantilevered engagement with the tubes.

The support hooks 26 are easily manually removed from engagement with their respective tubes 28 by simply raising the workpiece engaging portion 38 upward to pivot the contact portions 32*b* substantially back to horizontal, and thereafter sliding the support hook 26*b* away from the bars 28 to slide the contact portions 32*b* out from their respective apertures 58.

The formation of the apertures 58 in the tube 28 by punching or the like to leave an inwardly extending projection 60 beneath each of the apertures 58, as discussed above, eliminates operator error in attempting to engage the hooks upside-down. That is, if an operator were to attempt to engage a support hook 24 with its contact portion 32*b* extending downwardly (opposite to the orientation shown in FIGS. 1 and 2), the projections 60 would interfere with the contact portions 32*b*, giving an indication to the operator that the engagement is incorrect. The inwardly extending projections 60 beneath each of the apertures 58 also provide a smooth and relatively large fulcrum surface against which the offset portions 64*b* bear, as compared with the drilled-out holes or the like not having projections. The projections 60 thus reduce wear to the offset portions of the support hook 64*b*. The punching out of the apertures 58 to leave inwardly extending projections 60 is also less expensive than other manufacturing methods such as drilling or the like, so that even if operator error and wearing of support hook 64*b* are not of concern, the formation of the apertures 58 by punching or the like to leave inwardly extending projections 60 is preferred.

Figure 3:
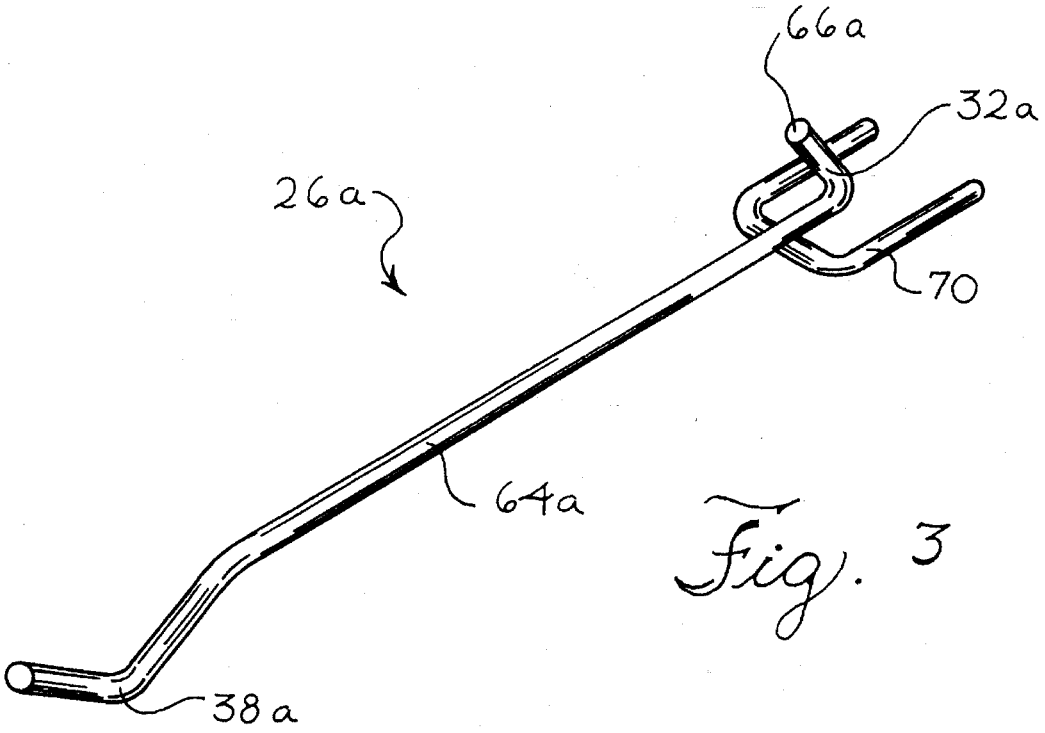
FIG. 3 is a perspective view of a support hook embodying various features of the present invention.

While the preferred embodiment discussed above was with regard to support hook 26*b* which engages with a pair of tubes 28, the hanging rack 20 of the present invention lends itself to use with an infinite variety of different support hooks 26. An alternative embodiment support hook 26*a* is illustrated in perspective view in FIG. 3, and shown engaged with a tube 28 in FIGS. 1 and 2. The support hook 26*a* engages with a single tube 28, as compared with the support hook 26*b* discussed above which engages with a pair of tubes 28.

The support hook 26*a* has a workpiece engaging portion 38*a* from which workpieces 24 may be hung, an offset portion 64*a* for spacing the workpiece-engaging portion 38*a* from the tube 28, and a contact portion 32*a* for contacting the interior surface 34 of the tube 28 to which the support hook 26*a* is engaged. The support hook 26*a* engages with the tube 28 in essentially the same manner as the support hook 26*b* engages with the pair of tubes 28*a* (discussed above), except that the support hook 26*a* only engages with a single tube 28. As discussed above with regard to the support hook 26*b*, the support hook 26*a* engages with the tube 28, for cantilevered engagement therewith, by raising the workpiece-engaging portion 38*a* of the support hook 26*a* to move the contact portion 32*a* to a substantially horizontal orientation and then inserting the contact portion 32*a* through an aperture 58 in the tube 28. Upon release of the support hook 26*a*, the workpiece-engaging portion 38*a* falls downwardly under the influence of gravity. Downward movement of the workpiece-engaging portion 38*a* of the support hook 26*a* is limited by abutment of the end 66*a* of the contact portion 32*a* with the interior surface 34 of the tube 28. The corner 68 serves as a fulcrum and the offset portion 64*a* bears against the corner 68, with the end 66*a* of the contact portion 32*a* bearing against the interior surface 34 of the tube 28, to support and maintain the support hook 26*a* in cantilevered engagement with the tube 28. The weight of workpieces 24 suspended from the workpiece-engaging portion 38*a* of the support hook 26*a* forces the end 66*a* of the contact portion 32*a* of the support hook 26*a* into firm abutment with the interior surface 34 of the tube 28 to assure that good electrical contact is maintained between the support hook 26*a* and the tube 28. The workpiece engaging portion 38*a* of the support hook 26*a* is V-shaped to prevent workpieces 24 from falling off the support hook 26*a* and to maintain a consistent point of contact of workpieces 24 engaged with the workpiece-engaging portion 38*a* of the support hook 26*a*, to help in maintaining good electrical contact between the support hook 26*a* and the workpieces 24 suspended therefrom. The support hook 26*a* also has an integral U-shaped portion 70 which is disposed adjacent each of the front, inner and outer sides 50, 48, and 44 respectively, to prevent the support hook 26*a* from rotating and possibly becoming disengaged from the tube 28, and to reduce lateral swinging of the support hook 26*a* with respect to the tube 28.

Figure 5:
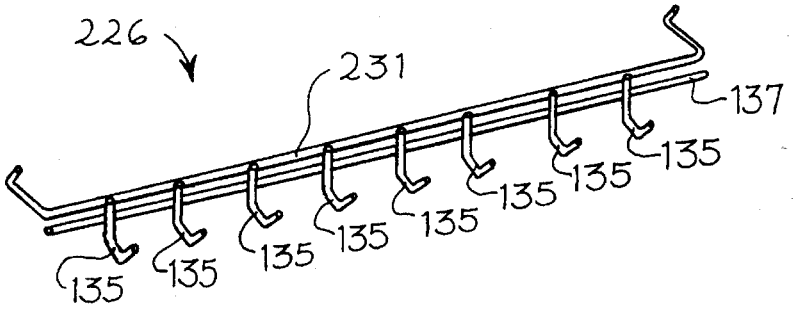
FIG. 5 is a perspective view of another support hook embodying various features of the present invention.
Figure 6:
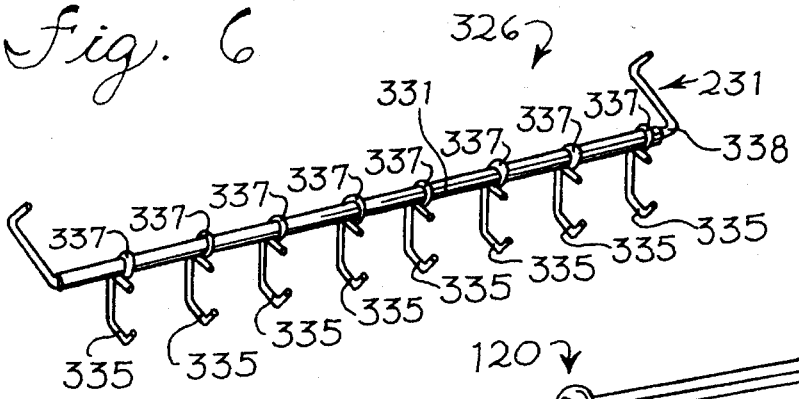
FIG. 6 is a perspective view of yet another support hook embodying various features of the present invention.
Figure 7:
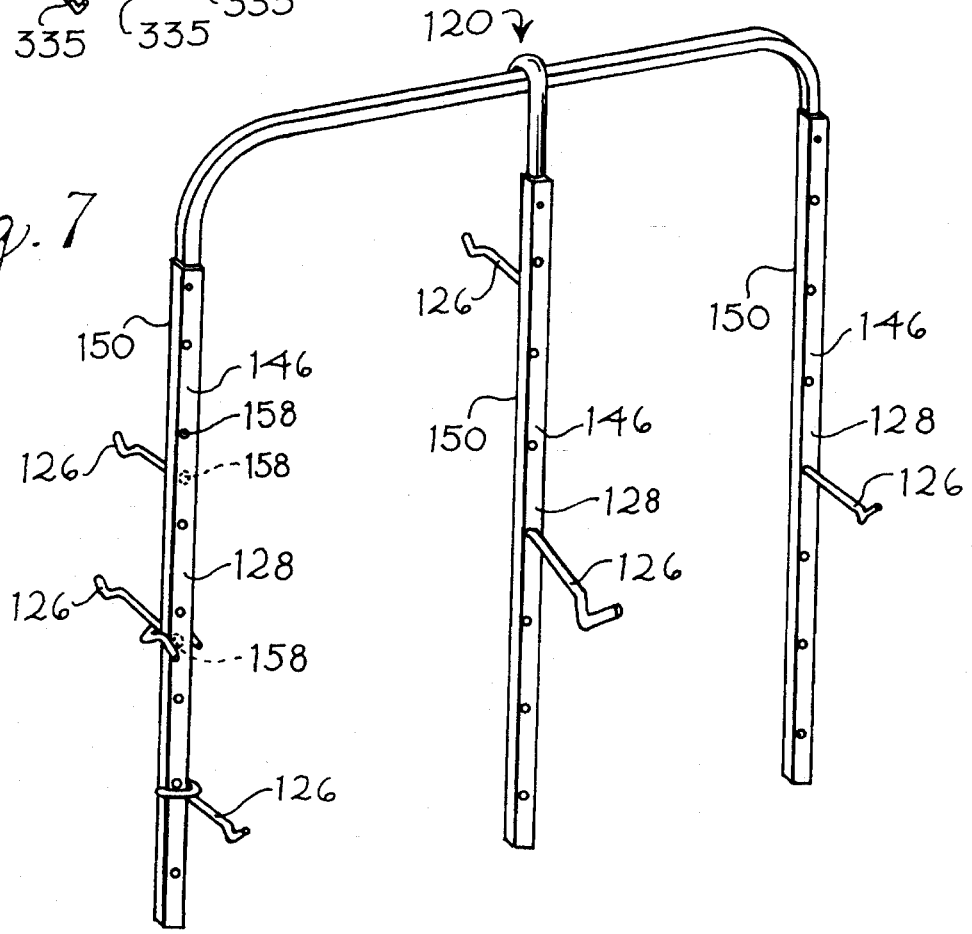
FIG. 7 is a perspective view of another hanging rack with cantilevered support hooks embodying various features of the present invention, in which hook-receiving apertures are provided on either side of the support tubes.

An alternative embodiment hanging rack 120 is illustrated in FIG. 7. In this embodiment of the invention, hook-receiving apertures 158 are provided in both the front and rear walls 146 and 150 of the tube 128, with the apertures 158 in the front wall 150 being offset from the apertures 158 in the rear wall 148. The offsetting of the apertures prevents interference between parts hung from hooks engaged in the front wall apertures and parts hung from hooks engaged in the rear wall apertures. FIG. 7 shows hooks 126 engaged in some of the apertures in both the front and rear walls of the tubes. With reference to FIGS. 5 and 6, further alternative embodiments of support hooks are illustrated. In the embodiment of FIG. 5, a hook 226 is shown. A bar 231, such as the hook 26*a* of FIG. 4, is provided which has a plurality of short hooks 135 welded thereto and also welded to a rod 137 disposed substantially parallel to the bar 231. The welding of the hooks 135 to both the bar 231 and rod 137 has been found to allow the composite hook 226 to withstand the high temperatures associated with burnoff ovens in which the temperature may be in the range of approximately 800° F. Stainless steel hooks 135 having a diameter of approximately 0.091 inch welded to a bar 231 and rod 137 each of approximately 3/16 inch diameter, and approximately 25 foot length, has been found to provide good results.

In the embodiment of FIG. 6, another hook 326 is illustrated. A bar 231, such as the hook 26*a* of FIG. 4, is provided which has its hook-engaging portion 338 disposed in a tube 331. Short hooks 335 have an end 337 wrapped about and welded to the tube 331.

While the invention has been described with reference to a preferred embodiment and alternative embodiments, it will be understood to those skilled in the art that various changes and modifications may by made, and equivalents may be substituted for elements thereof, without departing from the scope of the invention. In addition, it is intended that the invention not be limited to the particular embodiments disclosed as the best mode for carrying out this invention, but that the invention will include all embodiments falling within the scope of the appended claims.

What is claimed is:

1. A rack for supporting workpieces during transport through a finishing station, comprising:

a support frame including a tube having a pair of opposite ends and having an interior surface defining an elongated, substantially enclosed hollow interior, with a hook-receiving aperture disposed intermediate the ends of the tube and extending into said hollow interior of the tube;

a support hook having a tube-engaging portion with means for receipt into the hook-receiving aperture of the tube for cantilevered engagement of the support hook with the tube;

the support hook having a contact portion for contacting the interior surface of the tube during engagement of the support hook with the tube and having a workpiece-engaging portion for supporting the workpieces in spaced relation from the tube, with the weight of the workpieces engaged with the workpiece-engaging portion of the support hook biasing the contact portion of the support hook into positive electrical contact with the interior surface of the tube.

2. A rack in accordance with claim 1 in which the support hook is a rigid, non-resilient member.

3. A rack in accordance with claim 1 in which said tube is a vertically extending tube.

4. A rack in accordance with claim 3 in which:

said support frame further comprises a second tube extending generally parallel to said vertically extending tube, the second tube having an interior surface defining an elongated, substantially enclosed hollow interior, with a hook-receiving aperture intermediate its ends extending into said hollow interior of the second tube;

said support hook having a second tube-engaging portion with means for receipt into the hook-receiving aperture of the second tube and having a second contact portion for contacting the interior surface of the second tube;

each of the pair of tube-engaging portions of the support hook being receivable into respective hook-receiving apertures of the first and second tubes for cantilevered engagement of the support hook with both the first and second tubes;

the weight of the workpieces engaged with the workpiece-engaging portion of the support hook biasing both of the pair of contact portions of the support hook into positive electrical contact with the respective interior surfaces of the first and second tubes.

5. A rack in accordance with claim 4 in which the support hook has a pair of opposite first and second ends and the pair of tube-engaging portions of the support hook are disposed at respective first and second ends of the support hook, and the workpiece-engaging portion of the support hook spans said first and second ends.

6. A rack in accordance with claim 1 in which said tube has a plurality of hook-receiving apertures.

7. A rack in accordance with claim 1 in which;

the support hook has an upper side and a lower side; and said tube has an upper end and a lower end and an integral projection extending into said tube interior adjacent said hook-receiving aperture for preventing engagement of said support hook with the tube with the lower side of the support hook facing the upper end of the tube.

8. A rack in accordance with claim 1 in which said tube is generally rectangularly cylindrical.

9. A rack in accordance with claim 1 in which the tube has an exterior surface and the support hooks have an aligning portion engageable with the exterior surface of the tube to maintain alignment of the support hooks with respect to the tube.

10. A rack for supporting workpieces during transport through a finishing station, comprising:

a support frame including a tube having a pair of opposite ends and having an interior surface defining an elongated, substantially enclosed hollow interior, with a hook-receiving aperture disposed intermediate of the ends of the tube and extending into said hollow interior of the tube;

a support hook having a tube-engaging portion receivable into the hook-receiving aperture of the tube for cantilevered engagement of the support hook with the tube;

the support hook having an integral workpiece-engaging portion for supporting the workpieces and having an integral offset portion interconnecting said tube engaging portion with said workpiece engaging portion for spacing the workpieces supported on said workpiece-engaging portion in spaced relation from the tube;

the tube engaging portion of the support hook defining a contact surface, with the weight of said workpieces supported on the workpiece-engaging portion of the support hook biasing the contact surface of the support hook into positive electrical contact with the interior surface of the tube.

11. An integral, electrically conductive support hook for use in electrostatic coating operations, the support hook being engageable by cantilevered engagement with a pair of spaced hollow tubes each having an interior surface defining an elongated, substantially enclosed hollow interior which interior is shielded by the tube from particulate associated with the electrostatic coating operations, the tubes each having a hook-receiving aperture extending into said hollow interior, the support hook comprising:

contact portions for insertion through the hook-receiving apertures of the tubes into the hollow interiors thereof;

offset portions having a proximal end integrally connected to each of said contact portions and a distal end disposed in spaced relation from said contact portion;

a workpiece-engaging portion integrally connected between the distal ends of said offset portions for supporting workpieces in spaced relation from the tubes;

the support hook being engageable with the tubes by insertion of the contact portions through the hook-receiving apertures into the hollow interior of the tubes, with the contact portions bearing against the internal surfaces of the tubes and the offset portions bearing against the lower portions of the tube surfaces defining the hook-receiving apertures to support the support hook in cantilevered engagement with the tubes;

and the weight of said workpieces supported on said workpiece-engaging portion exerting a corresponding force on said contact portions of the cantilevered support hook to force the contact portions of the support hook against the interior surfaces of the tubes to assure good electrical contact between the tubes and the support hook.

12. A support hook in accordance with claim 11 in which the contact portions are perpendicular to the offset portions.

* * * * *